US011091884B2

(12) United States Patent
Weitersberger

(10) Patent No.: US 11,091,884 B2
(45) Date of Patent: Aug. 17, 2021

(54) TRACK-LAYING VEHICLE FOR PERFORMING TRACK LAYING WORKS

(71) Applicant: Plasser & Theurer Export von Bahnbaumaschinen Gesellschaft m.b.H., Vienna (AT)

(72) Inventor: Christian Weitersberger, St. Georgen an der Gusen (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 536 days.

(21) Appl. No.: 16/070,409

(22) PCT Filed: Jan. 18, 2017

(86) PCT No.: PCT/EP2017/000051
§ 371 (c)(1),
(2) Date: Jul. 16, 2018

(87) PCT Pub. No.: WO2017/140405
PCT Pub. Date: Aug. 24, 2017

(65) Prior Publication Data

US 2021/0054577 A1 Feb. 25, 2021

(30) Foreign Application Priority Data

Feb. 15, 2016 (AT) ..... A 73/2016

(51) Int. Cl.
*E01B 29/16* (2006.01)
*B66C 23/50* (2006.01)

(52) U.S. Cl.
CPC ..... *E01B 29/16* (2013.01); *B66C 23/50* (2013.01)

(58) Field of Classification Search
CPC ..... E01B 29/00; E01B 29/02; E01B 29/04; E01B 29/05; E01B 29/16; E01B 29/17;
(Continued)

(56) References Cited

U.S. PATENT DOCUMENTS 724,577 A 4/1903 Holman et al.
4,979,247 A 2/1990 Buhler
(Continued)

FOREIGN PATENT DOCUMENTS

AT 518062 B1 7/2017
AU 2005309124 A1 6/2006
(Continued)

OTHER PUBLICATIONS

Chinese Office Action in Chinese Patent Application No. 201780009232.5, dated Dec. 23, 2019 with English Translation.
(Continued)

*Primary Examiner* — Robert J McCarry, Jr.
(74) *Attorney, Agent, or Firm* — Collard & Roe, P.C.

(57) ABSTRACT

A longitudinal beam of a track maintenance vehicle is connected at a beam exterior side—facing away from the opposite longitudinal beam—to a rail transport device provided for receiving rails. The rail transport device is displaceable by means of a displacement drive in the transverse direction of the machine relative to a machine frame within a displacement path s delimited by a transport—and a loading position.

7 Claims, 2 Drawing Sheets

Figure 1:
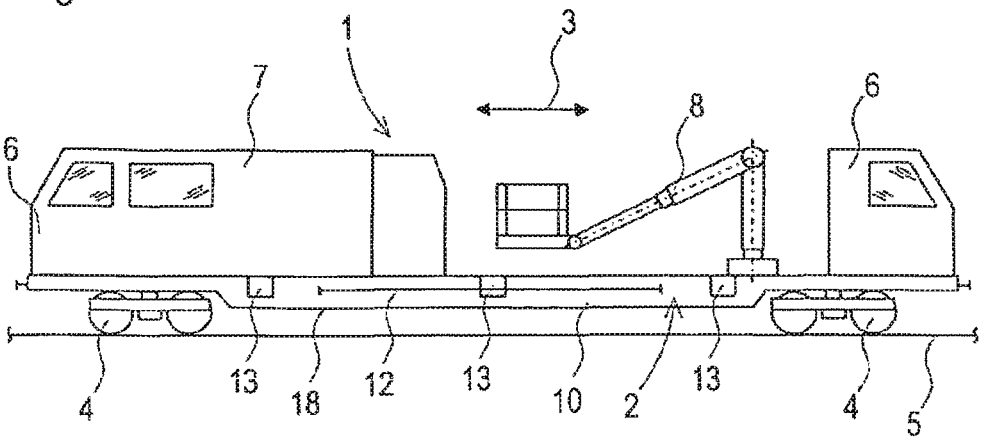

(58) Field of Classification Search
CPC ..... E01B 31/00; E01B 31/02; E01B 33/00; E01B 33/02; E01B 33/06; E01B 33/08; E01B 33/10; E01B 33/12
See application file for complete search history.

(56) References Cited

U.S. PATENT DOCUMENTS

| | | | | |
|---|---|---|---|---|
| 4,955,301 | A | 9/1990 | Theurer et al. | |
| 5,469,791 | A | 11/1995 | Theurer et al. | |
| 2004/0144282 | A1* | 7/2004 | Huwer | E01B 29/16 104/2 |
| 2007/0199472 | A1 | 8/2007 | Theurer et al. | |
| 2009/0095188 | A1* | 4/2009 | Bounds | E01B 29/16 104/2 |
| 2019/0010666 | A1 | 1/2019 | Hechenberger | |
| 2021/0054577 | A1 | 2/2021 | Weitersberger | |

FOREIGN PATENT DOCUMENTS

| | | | | |
|---|---|---|---|---|
| CN | 1032049 | A | 3/1989 | |
| CN | 102933768 | A | 2/2013 | |
| CN | 103015278 | A | 4/2013 | |
| CN | 203938942 | U | 11/2014 | |
| DE | 44 31 503 | A1 | 3/1995 | |
| DE | 202016000509 | U1 | 3/2016 | |
| EP | 0 355 240 | A1 | 2/1990 | |
| FR | 1 013 191 | A | 7/1952 | |
| GB | 2 160 919 | A | 1/1986 | |
| JP | S52-52211 | U | 4/1977 | |
| WO | WO-2009003554 | A1 * | 1/2009 | B66C 23/022 |

OTHER PUBLICATIONS

International Search Report of PCT/EP2017/000051, dated Mar. 21, 2017.

* cited by examiner

TRACK-LAYING VEHICLE FOR PERFORMING TRACK LAYING WORKS

CROSS REFERENCE TO RELATED APPLICATIONS

This application is the National Stage of PCT/EP2017/000051 filed on Jan. 18, 2017, which claims priority under 35 U.S.C. § 119 of Austrian Application No. 73/2016 filed on Feb. 15, 2016, the disclosures of which are incorporated by reference. The international application under PCT article 21(2) was not published in English.

The invention relates to a track maintenance vehicle for carrying out track maintenance operations, including a machine frame having on-track undercarriages spaced from one another in a longitudinal direction of the machine, the machine frame being delimited with respect to a transverse direction of the machine by two longitudinal beams spaced from one another.

Track maintenance vehicles of this type are widely known and, for carrying out various maintenance operations on the track, are often equipped with a crane. If required, the rails are renewed also in short track sections. To that end, it is economically advantageous to transport the new rails with the track maintenance vehicle to the construction site.

It is the object of the present invention to provide a track maintenance vehicle of the type mentioned at the beginning with which a simplified rail transport is possible.

According to the invention, this object is achieved with a track maintenance vehicle of the specified kind in that at least one longitudinal beam is connected at a beam exterior side—facing away from the opposite longitudinal beam—to a rail transport device, provided for receiving rails, which is displaceable by means of a displacement drive in the transverse direction of the machine relative to the machine frame within a displacement path delimited by a transport position and a loading position.

A rail transport device designed in this way has the particular advantage that, even if transporting up to 20 meter long rails, if needed, the versatile operability of the track maintenance vehicle for other track maintenance operations is in no way compromised. The loading of the rails can be carried out without problems by means of a machine-specific crane. As a result of the arrangement of the rail transport device laterally on the longitudinal beam of the machine frame, a subsequent retrofitting of machines already in operation is also possible.

Additional advantages of the invention become apparent from the dependent claims and the drawing description.

Figure 3:
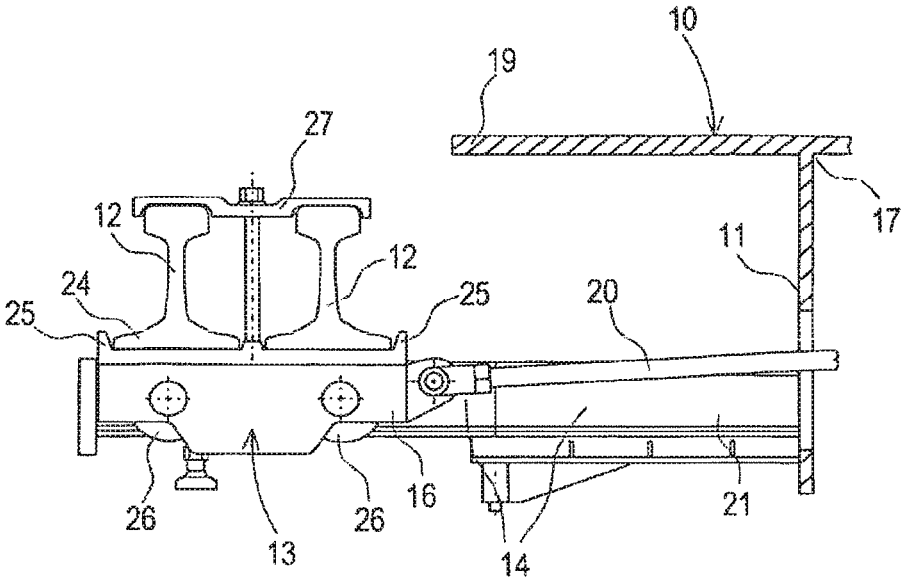
Figure 4:
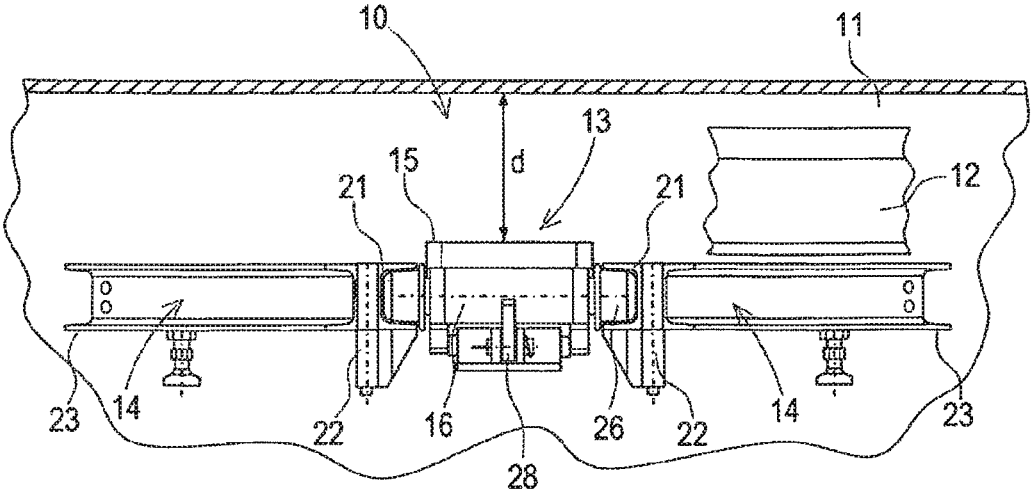

The invention will be described in more detail below with reference to an embodiment represented in the drawing in which FIG. 1 is a simplified side view of a track maintenance vehicle having rail transport devices and being designed for carrying out various track maintenance operations, FIGS. 2 and 3 each are a view of the rail transport device in a longitudinal direction of the machine, and FIG. 4 is a view of the rail transport device in a transverse direction of the machine.

A track maintenance vehicle 1, visible in FIG. 1, for carrying out track maintenance operations has a machine frame 2 with on-track undercarriages 4 spaced from one another in a longitudinal direction 3 of the machine and is mobile on a track 5. In addition to driver's cabs 6 arranged at the ends, a common room 7 for track maintenance workers as well as a crane 8, rotatable and vertically adjustable by drives, are also provided.

Figure 2:
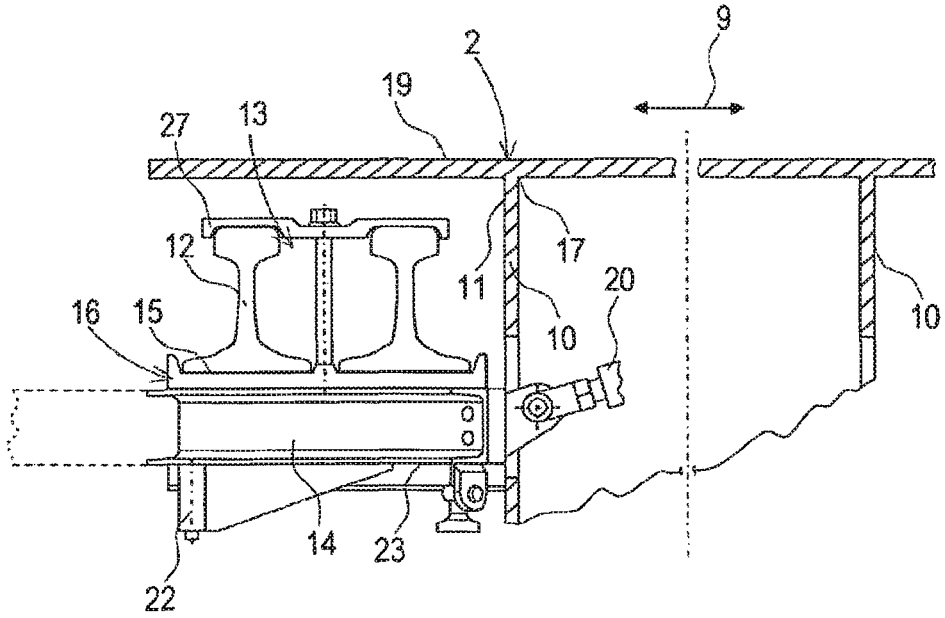

As can be seen in FIG. 2, the machine frame 2 is delimited with regard to a transverse direction 9 of the machine by two longitudinal beams 10 spaced from one another. Each longitudinal beam 10 is connected at a beam exterior side 11—facing away from the opposite longitudinal beam 10—to a total of three rail transport devices 13 arranged one following the other in the longitudinal direction 3 of the machine and provided for receiving rails 12 (see FIG. 1). For the sake of simplicity, the transport devices 13 arranged on the opposite longitudinal beam 10 are not shown in FIG. 2.

As visible in FIGS. 2 to 4, the rail transport device 13 is designed as a carriage 16 mounted for displacement in the transverse direction 9 of the machine along carriage guides 14 and having a rail storage surface 15. The longitudinal beam 10, designed as an I-beam in cross-section, has at an upper and lower end 17, 18 a respective beam flange 19 extending horizontally. A distance d, delimited by the rail storage surface 15 and the upper beam flange 19, is configured to correspond to a height of the rail 12 to be transported.

The rail transport device 13 is arranged—with regard to a vertical—between the upper and lower end 17, 18 of the longitudinal beam 10. The carriage 16 is displaceable by means of a displacement drive 20 in the transverse direction 9 of the machine relative to the machine frame 2 within a displacement path delimited by a transport- and a loading position (see FIG. 2 or 3).

As visible particularly also in connection with FIG. 4, the carriage guide 14 provided at either side of the carriage 16 is composed in each case of a first guide rail 21, connected to the longitudinal beam 10, and a second guide rail 23 connected to the former by a joint 22. The second guide rail 23 has a length corresponding to the displacement path of the carriage 16. Each carriage 16 is connected to guide rollers 26 mounted inside the guide rails 21, 23. The rail storage surface 15 has centring ribs 25, projecting beyond the surface, which extend in the longitudinal direction 3 of the machine and are spaced from one another in the transverse direction 9 of the machine for receiving rail bases 24.

For loading the rails 12, the second guide rails 23 are pivoted out into an operating position aligned with the first guide rails 21, and locked. Subsequently, with actuation of the displacement drives 20, the carriages 16 are displaced into the loading position visible in FIG. 3. With the aid of the crane 8, both rails 12 (or only one, if required) are placed upon the rail storage surface 15 and connected by means of a transport safeguard 27 to the respective carriage 16.

With actuation of the displacement drives 20, the carriages 16 together with the two rails 12 are displaced into the transport position (see FIG. 2). With the aid of an arresting device 28 (see FIG. 4), transport safeguarding of the carriages 16 takes place. Finally, the second guide rails 23 are pivoted into a transport position visible in FIGS. 2 and 4, and fixed. After arrival at the construction site and displacement of the carriages 16 into the loading position, the two rails 12 are placed upon the track 5, again with the aid of the crane 8.

The invention claimed is:

1. A track maintenance vehicle for carrying out track maintenance operations, comprising:

a machine comprising a crane a machine frame coupled to the machine;

on-track undercarriages coupled to the machine frame, and spaced from one another in a longitudinal direction of the machine;

at least one displacement drive coupled to the machine frame;

at least two longitudinal beams, formed integral with the machine frame, wherein the machine frame being delimited with respect to a transverse direction of the machine by said two longitudinal beams spaced from one another, a rail transport device wherein at least one longitudinal beam of said at least two longitudinal beams is connected at a beam exterior side—facing away from the opposite longitudinal beam—to said rail transport device, provided for receiving rails, which is displaceable by means of said displacement drive in the transverse direction of the machine relative to the machine frame within a displacement path delimited by a transport position and a loading position;

wherein the rail transport device is arranged with regard to a vertical between the upper and lower end of each associated longitudinal beam of said at least two longitudinal beams.

2. The vehicle according to claim 1, wherein the rail transport device is arranged—with regard to a vertical—between an upper and lower end of the longitudinal beam.

3. The vehicle according to claim 1, wherein the rail transport device is designed as a carriage mounted for displacement in the longitudinal direction of the machine along carriage guides and having a rail storage surface.

4. The vehicle according to claim 1, wherein the longitudinal beam, designed as an I-beam in cross-section, has a horizontally extending beam flange at the upper and lower end respectively, wherein a distance d delimited by the rail storage surface and the beam flange is configured to correspond to at least a height of a rail to be transported.

5. The vehicle according to claim 3, wherein the carriage guide is composed of a first guide rail, connected to the longitudinal beam, and a second guide rail connected to the former by means of a joint, the second guide rail having a length corresponding to the displacement path.

6. The vehicle according to claim 1, wherein each of the two longitudinal beams is connected to three transport devices spaced from one another in the longitudinal direction of the machine.

7. The vehicle according to claim 3, wherein each carriage has three centring ribs, projecting beyond the rail storage surface, which extend in the longitudinal direction of the machine and are spaced from one another in the transverse direction of the machine for receiving rail bases.

* * * * *